US006546909B1

(12) United States Patent
Clarke et al.

(10) Patent No.: US 6,546,909 B1
(45) Date of Patent: Apr. 15, 2003

(54) PISTON FOR A THERMAL REGENERATED ENGINE

(75) Inventors: John M. Clarke, Chillicothe, IL (US); Eric C. Fluga, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/017,307

(22) Filed: Dec. 7, 2001

(51) Int. Cl.[7] ..... F02F 3/14
(52) U.S. Cl. ..... 123/254; 123/279; 123/543
(58) Field of Search ..... 123/254, 279, 123/541, 542, 543

(56) References Cited

U.S. PATENT DOCUMENTS 4,280,468 A * 7/1981 Millman ..... 123/546
4,284,055 A * 8/1981 Wakeman ..... 123/556
4,790,284 A 12/1988 Ferrenberg et al.
4,928,658 A * 5/1990 Ferrenberg et al. ..... 123/543
4,936,262 A * 6/1990 Paul et al. ..... 123/25 C
5,499,605 A * 3/1996 Thring ..... 123/70 R
5,540,191 A 7/1996 Clarke
5,632,255 A * 5/1997 Ferrenberg ..... 123/543
6,116,222 A 9/2000 Warren
6,199,520 B1 3/2001 Warren
6,253,746 B1 7/2001 Warren

* cited by examiner

*Primary Examiner*—Erick Solis
(74) *Attorney, Agent, or Firm*—Thomas L Derry

(57) ABSTRACT

Internal combustion engines have been developed having regeneration mechanisms for increasing efficiency and reducing emissions. Previous regeneration mechanisms have been complicated and costly. The present invention provides a simple regeneration member which is attached within a piston assembly. Thus the apparatus for attaching the regeneration member within the internal combustion engine greatly reduces the cost of the engine.

18 Claims, 5 Drawing Sheets

PISTON FOR A THERMAL REGENERATED ENGINE

TECHNICAL FIELD

This invention relates generally to an internal combustion engine and more specifically to a piston having a thermal regenerator attached therein.

BACKGROUND

Thermal regeneration has been developed for increasing the thermal efficiency of internal combustion engines. Thermal regeneration consist of the introduction of a heat exchanger within the engine. The heat exchanger includes a porous core that is capable of withstanding high temperatures. During the exhaust stroke of the engine, the core absorbs exhaust gas heat. The exhaust gas heat is then transferred from the core to working fluid (air/fuel mixture) following the compression stroke, but prior to or during the combustion of fuel.

A regenerative internal combustion engine is disclosed in U.S. Pat. No. 5,540,191 issued to Caterpillar, Inc. on Jul. 30, 1996, wherein a regenerator captures a portion of unutilized heat normally expelled with exhaust gas, and transfers the captured heat to the fresh working fluid. The above identified patent includes a regenerative member moveably positioned in the cylinder of the engine between the piston and the cylinder head. The regenerator is adapted to reciprocate in relationship to the piston movement.

Obstacles to using a regenerator as described above include the need to construct an internal combustion engine having an additional mechanism for moving the regenerator between the piston and the cylinder head. Previous designs required a separate reciprocating mechanism for moving the regenerator. The separate reciprocating mechanism requires additional features to be cast into the engine components, additional parts, a sealing arrangement to prevent compression loss in the cylinder and additional assembly time.

The above identified invention is directed to overcoming one or more of the above identified problems.

SUMMARY OF THE INVENTION

In an aspect of the present invention a piston assembly for an internal combustion engine is provided. The internal combustion engine includes a combustion cylinder, a predefined cycle including an intake stroke and a compression stroke. The piston assembly includes a piston head having a top surface. The top surface defines a recessed portion. A regeneration member having a porous structure is positioned within the recessed portion.

In another aspect of the present invention an internal combustion engine is provided. The internal combustion engine has a predefined cycle including a combustion stroke and an intake stroke prior to the compression stroke. The piston assembly having a top surface defining a recessed portion. A regeneration member is provided in the recessed portion and has a porous structure. The regeneration member is adapted to absorb heat from the combustion stroke and release the heat during the intake stroke.

In another aspect of the present invention a method for operating an internal combustion engine is provided. The internal combustion engine has a combustion cylinder and a predefined cycle including an intake stroke and an compression stroke. The method includes the steps of providing a regeneration member within a piston assembly, providing air to said combustion cylinder during the intake stroke, pushing an intake air through the regeneration member, introducing fuel, mixing fuel and intake air, igniting the fuel and intake air mixture, creating heat and absorbing heat with the regeneration member.

DETAILED DESCRIPTION

Figure 1:
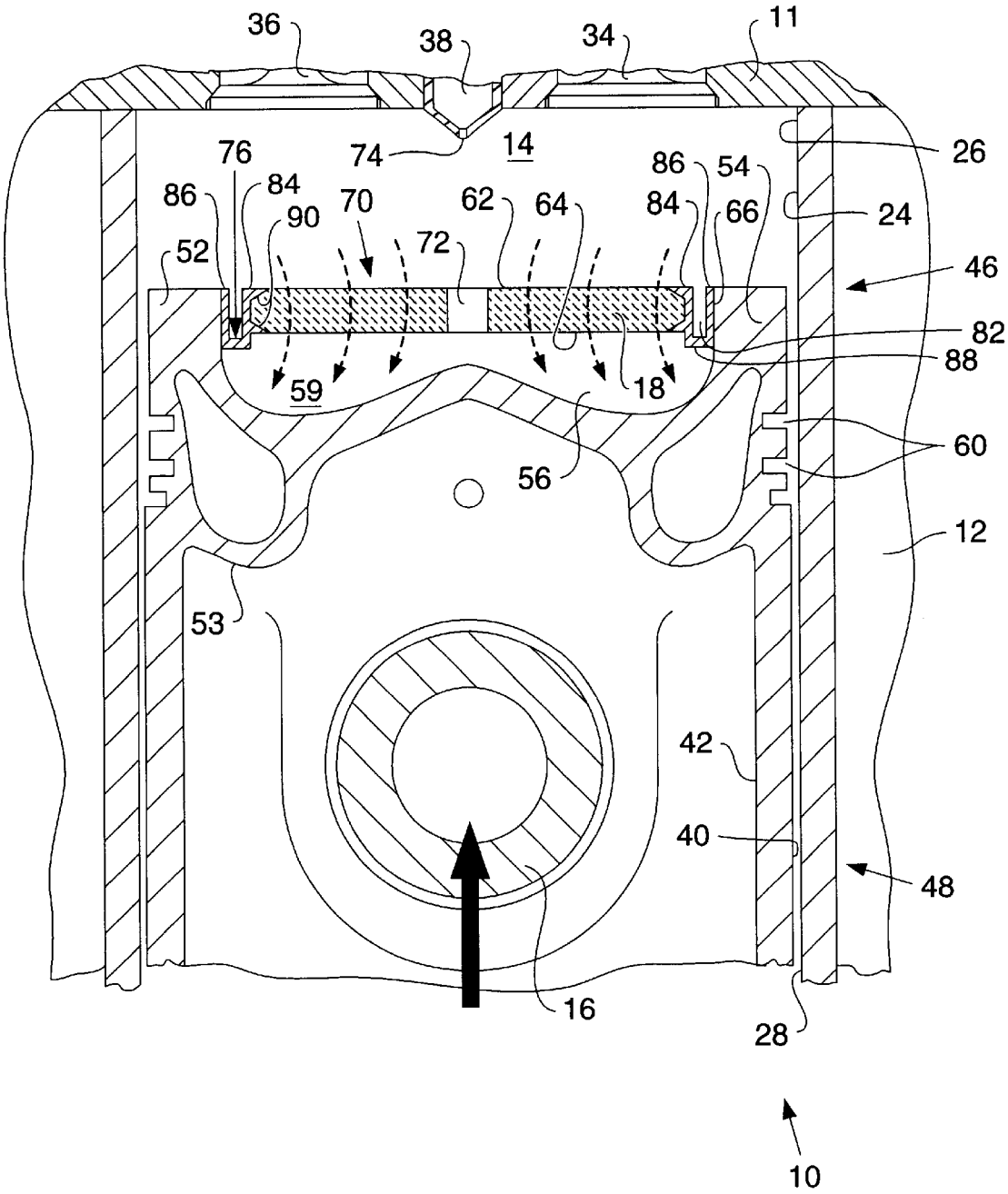
FIG. 1 is a sectional illustration of a combustion cylinder of an internal combustion engine having a regeneration member disposed within a recessed portion of a piston, a cycle of the internal combustion engine is illustrated as the piston begins a compression stroke.
Figure 2:
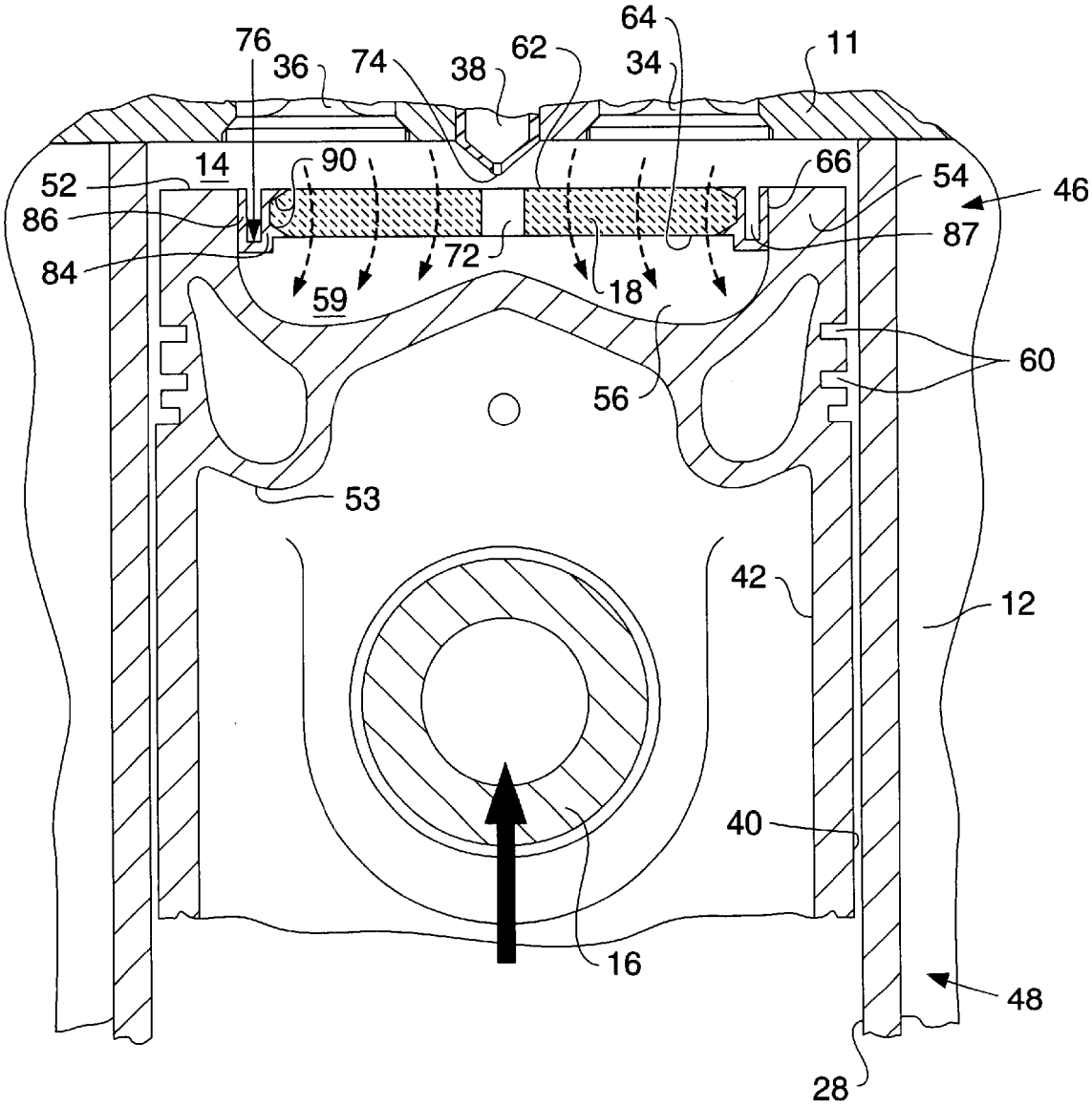
FIG. 2 is a sectional illustration of the combustion cylinder of the internal combustion engine having a regeneration member disposed within the recessed portion of the piston, a cycle of the internal combustion engine is illustrated as the piston nears top-dead-center.
Figure 3:
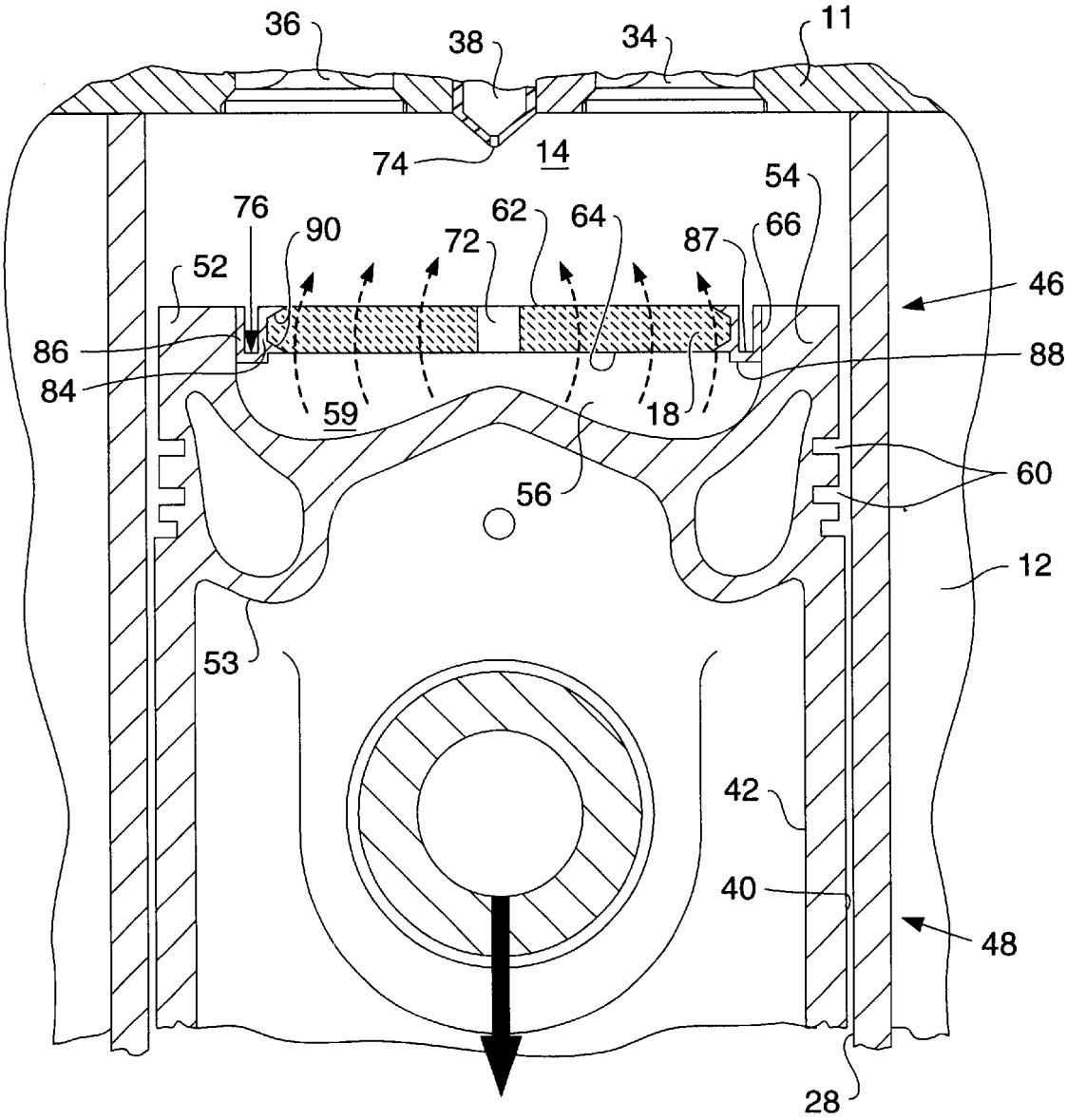
FIG. 3 is a sectional illustration of the combustion cylinder of the internal combustion engine having the regeneration member disposed within a recessed portion of the piston, a cycle of the internal combustion engine is illustrated as it moves away from top dead center.

Referring now to FIGS. 1, 2 and 3, a sectional illustration of an internal combustion engine is depicted generally as 10. The internal combustion engine 10 may be either a two cycle or a four cycle engine. In either case, there is at least an intake stroke and an compression stroke. The internal combustion engine 10 includes a cylinder head 11 and a block 12 having a plurality of combustion cylinders 14 therein, only one being shown. A piston assembly 16 is positioned within the combustion cylinder 14. The piston assembly reciprocates within the combustion cylinder 14 and has a regeneration member 18 positioned therein.

The combustion cylinderl4 defines a cylinder wall 24 having a top end 26 and a bottom end 28. The cylinder head 11 is positioned at the top end 26 and has an intake valve 34, an exhaust valve 36 and a fuel injector 38 positioned therein. The fuel injector 38 has a plurality of nozzles 39 that are adapted to direct fuel into the combustion cylinder 14.

The piston assembly 16 is primarily of conventional construction, but the geometry may be modified slightly to accommodate the required thickness of the regeneration member 18. Although the piston assembly 16 is shown as a multi-piece construction, a single piece piston could be used without varying the inventive concept, as is show in FIG. 6. The piston assembly 16 is a substantially cylindrical member having an outer wall 40 and an inner wall 42, a top end 46 and a bottom end 48. The outer wall 40 extends from the top end 46 to the bottom end 48. A plurality of ring grooves 60 are defined in the outer wall 40 near the top end 46, as with a conventional piston assembly 16. A top surface 52 is defined on the top end 48. An underside surface 53 is spaced away from the top surface 52. The top surface 52 may be integral of the piston assembly 16 or may be a removable portion 54 as illustrated. A recessed portion 56 is defined in the top surface 52, the recessed portion 56 forms a bottom surface 57 and an inner-side surface 58. The regeneration member 18 is positioned within the recessed portion 56 and defines a cavity 59 between the regeneration member 18 and the bottom surface 57.

The regeneration member 18 may be manufactured from a ceramic material or a metal foam material. The regeneration member 18 has a porous structure 70 that withstands high temperatures. The regeneration member 18 is a disk shaped member having a top portion 62 and a bottom portion 64. An outer edge 66 extends between the top portion 62 and the bottom portion 64. At least a passage 72 is provided in the regeneration member and extends from the top portion 62 to the bottom portion 64. The passage(s) 72 is/are aligned with the nozzle(s) 39 provided in the fuel injector 38. An expansion member 76 is disposed between the outer edge 66 and the inner-side surface 58 of the piston assembly 16.

Figure 4:
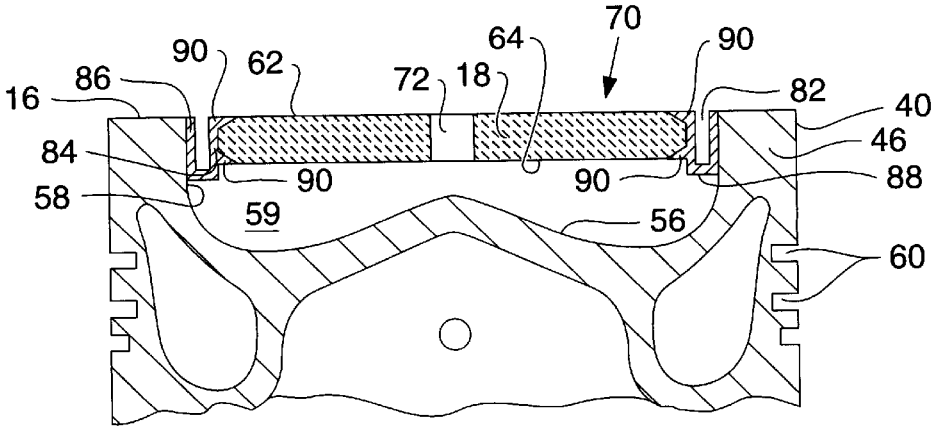
FIG. 4 is an enlarged sectional illustration of the present invention illustrating one embodiment of a mounting arrangement the regeneration member within a piston assembly.
Figure 5:
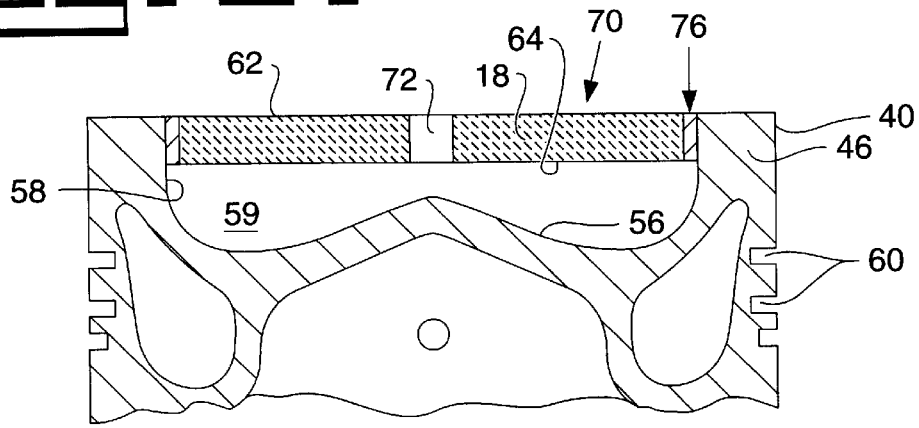
FIG. 5 is an enlarged sectional illustration of the piston of the present invention illustrating another embodiment of a mounting arrangement a regeneration member within the piston assembly.
Figure 6:
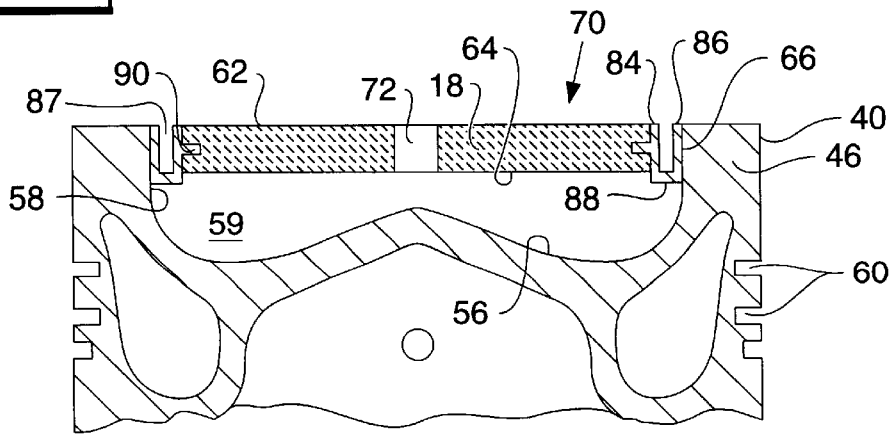
FIG. 6 is an enlarged sectional illustration of the present invention illustrating another embodiment of a mounting arrangement of the regeneration member within a piston.
Figure 7:
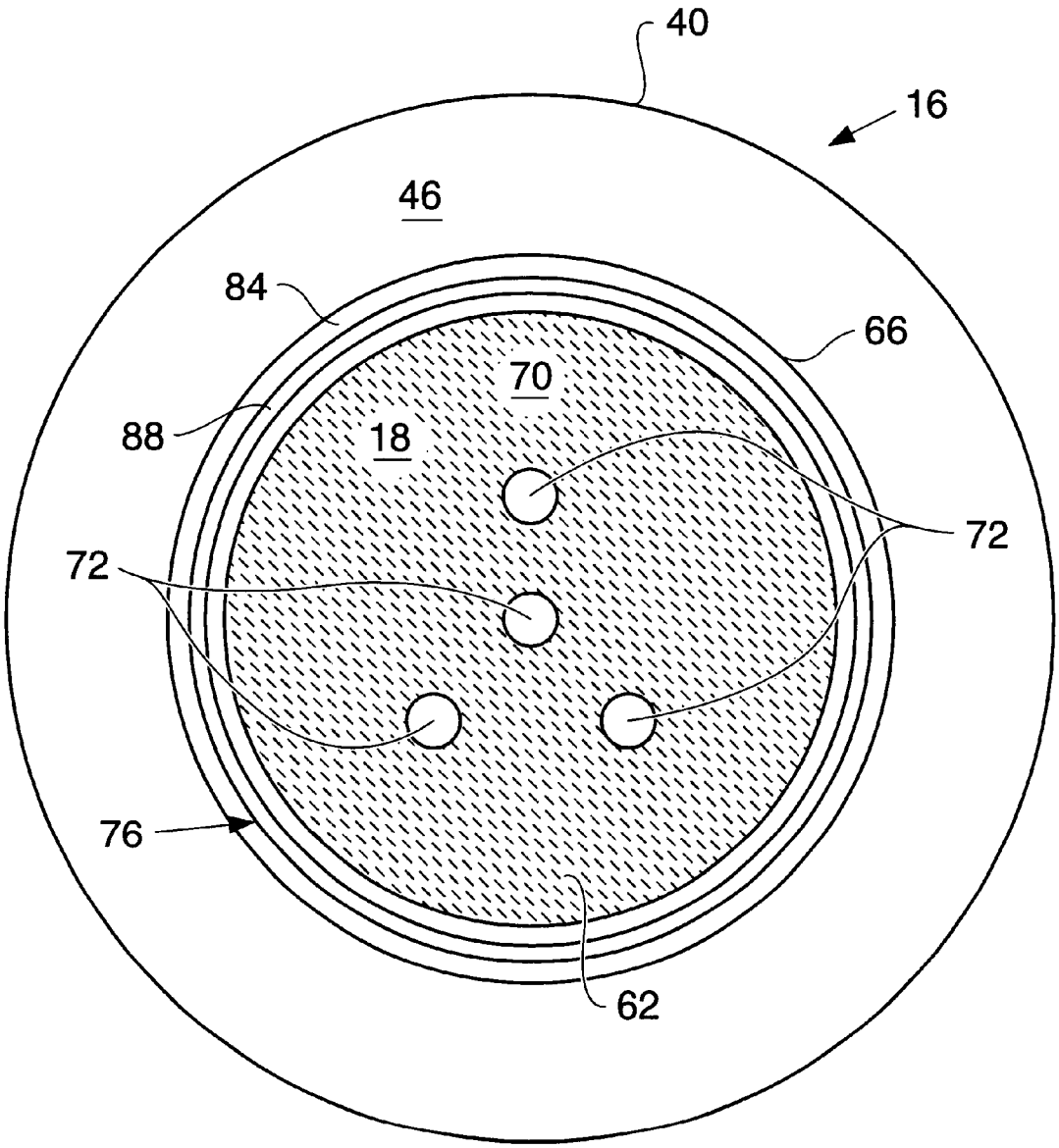
FIG. 7 is a top view of a piston having a regeneration member of the present invention.

As illustrated in FIGS. 4, 5 and 6, the expansion member 76 is a substantially ring shaped member. FIGS. 4 and 6 illustrate the expansion member 76 constructed from a metallic material. The expansion member 76 as illustrated in FIGS. 4 and 6 may be attached to the recessed portion 56 of the piston assembly 16 using conventional welding or bonding technologies that are capable of withstanding high temperatures. Alternately, FIG. 5 illustrates the expansion member 76 manufactured from an flexible heat resistant material. The expansion member as illustrated in FIG. 5 may include a chemical bonding adhesive. The expansion member 76 provides an isolation means 78 which in this application uses a gap, between the outer edge 66 of the regeneration member 18 and the recessed portion 56 of the piston assembly 16. As illustrated, the expansion member 76 includes a "U" portion 82 disposed about the outer edge 66 of the regeneration member 18. The "U" portion includes an inner vertical leg 84, an outer vertical leg 86 and a joint portion 88 that extends between the vertical legs 84,86. A horizontal member 90 extends radially inward from the inner vertical leg 84. As an alternative and illustrated in FIG. 4, two or more horizontal members 90 can be used without changing the intent of the invention. FIG. 6 illustrates a single horizontal member 76 extending into the regeneration member 18 whish is interposed the top portion 62 and the bottom portion.

INDUSTRIAL APPLICABILITY

In operation the present invention provides an internal combustion 10 engine having the regeneration member 18. During the intake stroke, intake valve 34 is opened and the piston assembly 16 moves toward bottom dead center in the combustion cylinder 14. As the piston assembly 16 moves toward bottom dead center, intake air is drawn into the combustion cylinder 14. At the end of the intake stroke, the intake valve 34 closes and the piston assembly 16 begins the compression stroke, moving toward top dead center.

During the compression stroke, the intake valve 34 and the exhaust valve 36 are closed. As the piston assembly 16 moves toward the cylinder head 11, the intake air in the combustion cylinder 14 is compressed and pushed through the porous construction of the regeneration member 18, and into the cavity 59. Near top dead center of the compression stroke, the nozzle 39 of the fuel injector 38 sprays fuel through the passage 72 of the regeneration member 18 and into the cavity 59. Thus, the fuel and intake air in the cavity reaches the appropriate temperature, combustion occurs within the cavity 59 and combustion cylinder 14.

After combustion and expansion occurs, the exhaust valve 36 opens and allows exhaust gas to exit the combustion cylinder 14 and cavity 59. Heat from the combustion process and exhaust gas is absorbed by the regeneration member 18. During the next cycle of the intake stroke, fresh intake air again passes through the porous structure of the regeneration member 18 and extracts heat from the regeneration member 18.

By providing a simple method and apparatus to capture heat from exhaust gases and transfer that heat to air before combustion, the efficiency and emissions of the internal combustion engine 10 is affordably improved.

Other aspects, objects and advantages of this invention can be obtained from a study of the drawings, the disclosure and the appended claims.

What is claimed is:

1. A piston assembly for an internal combustion engine, said internal combustion engine having a combustion cylinder, a predefined cycle including an intake stroke and a compression stroke, said piston assembly having a piston head defining a top surface, said piston comprising:

a recessed portion defined in said top surface;

a regeneration member positioned within said recessed portion of said piston assembly, said regeneration member having a porous structure; and a cavity being defined in said recessed portion between said regeneration member and said piston member.

2. The piston assembly of claim 1, wherein said internal combustion engine including a fuel injector having a nozzle, said regeneration member including an opening being in alignment with said nozzle of said fuel injector, and said opening communicating between said combustion cylinder and said cavity.

3. The piston assembly of claim 1, wherein said regeneration member being manufactured from metallic foam and having a porous configuration.

4. The piston assembly of claim 1, wherein said regeneration member being manufactured from a ceramic material and having a porous configuration.

5. The piston assembly of claim 1, wherein said regeneration member being attached to said piston by welding.

6. An internal combustion engine having a piston assembly reciprocally moveable within a combustion cylinder, said internal combustion engine having a predefined cycle including a combustion stroke creating a heat and an intake stroke being operatively positioned before said combustion stroke, said piston assembly having a piston head defining a top surface having an outer wall extending therefrom and an underside surface being spaced from said top surface, said internal combustion engine comprising:

a recessed portion being positioned in said piston head and forming a bottom surface being interposed said top surface and said underside surface;

a regeneration member being attached in said recessed portion, said regeneration member having a porous structure being adapted to absorb said heat from said combustion stroke and to release said heat during said intake stroke, prior to another combustion stroke of said internal combustion engine; and a cavity being formed between said regeneration member and said bottom surface of said recessed portion.

7. The internal combustion engine of claim 6, including a fuel injector having a nozzle, said regeneration member including an opening in alignment with said nozzle of said fuel injector, said opening communicating between said combustion cylinder and said cavity.

8. The internal combustion engine of claim 7, wherein said regeneration member being manufactured from metallic foam and having a porous configuration.

9. The internal combustion engine of claim 7, wherein said regeneration member being manufacture from a ceramic material and having a porous configuration.

10. The internal combustion engine of claim 7,wherein said regeneration member being attached to said piston by welding.

11. The internal combustion engine of claim 7, wherein said fuel injector has a plurality of nozzles.

12. The internal combustion engine of claim 11, wherein at least one of said nozzles is aligned with said opening.

13. A method for operating an internal combustion engine, said internal combustion engine having a combustion cylinder, a predefined cycle including, an intake stroke and combustion stroke, comprising the steps of:

providing a regeneration member within a piston assembly;

forming a cavity within said piston assembly;

providing an intake air to said combustion cylinder during said intake stroke;

pushing said intake air through said regeneration member into said cavity;

introducing a fuel into said cavity;

mixing said fuel and said intake air within said cavity;

igniting said mixed fuel and intake air;

creating a heat during said combustion stroke; and absorbing said heat with said regeneration member.

14. The method of operating said internal combustion engine of claim 13, wherein said step of introducing fuel includes said internal combustion engine having a fuel injector having a nozzle aligning an opening in said regeneration member.

15. The method of operating said internal combustion engine of claim 13, wherein said step of pushing said intake air through said regeneration member into said cavity includes said regeneration member being formed of a porous material.

16. The method of operating an internal combustion engine of claim 13, including a further step of said internal combustion engine having another intake stroke and said intake air absorbing said heat from said regeneration member.

17. The method of operating an internal combustion engine of claim 13, wherein said step of pushing said intake air through said regeneration member into said cavity includes said regeneration member being formed of a porous material and including a further step of said internal combustion engine having another intake stroke and said intake air absorbing said heat from said regeneration member.

18. The method of operating an internal combustion engine of claim 13, wherein said step of igniting said mixed fuel and intake air occurs in the combustion cylinder.

* * * * *